10/22/85 4,548,684

United States Patent [19]

Miyazaki et al.

[11] Patent Number: 4,548,684

[45] Date of Patent: Oct. 22, 1985

[54] TREATMENT OF MANGANESE NODULES

[75] Inventors: Kazuhide Miyazaki; Yasuo Kitamura; Toshiteru Okada, all of Takehara, Japan

[73] Assignee: Mitsui Mining & Smelting Co. Ltd., Tokyo, Japan

[21] Appl. No.: 620,388

[22] Filed: Jun. 13, 1984

[51] Int. Cl.[4] ..... C25C 1/08

[52] U.S. Cl. ..... 204/130; 204/105 M; 204/248; 204/293; 75/115; 75/117; 75/119

[58] Field of Search ..... 204/105 M, 130, 248, 204/106–107, 1, 2, 293, 2.1; 75/115, 117, 119

[56] References Cited

U.S. PATENT DOCUMENTS 4,372,823 2/1983 Church et al. ..... 204/2.1

4,400,247 8/1983 Ginatta ..... 204/105 M

*Primary Examiner*—R. L. Andrews

*Attorney, Agent, or Firm*—Kane, Dalsimer, Kane, Sullivan and Kurucz

[57] ABSTRACT

Valuable metals in manganese nodules have their solvent solubilities altered by forming an alkaline-manganese electric cell using manganese nodules as a cathode active material component and discharging the cell with a selected discharge load. Thus, the solvent extraction percentage for Mn in manganese nodules can be controlled to less than 60% and that for other valuable metals be elevated to at least 80% by selecting the discharge load properly.

5 Claims, 5 Drawing Figures

TREATMENT OF MANGANESE NODULES

BACKGROUND OF THE INVENTION

This invention relates to a method for treating manganese nodules occurring on the ocean floor, and particularly relates to a process for extracting and recovering valuable metals in manganese nodules.

In recent years, the utilization of manganese nodules has become of great importance. This is because manganese nodules contain, in addition to manganese which is a principal component, valuable metals such as nickel, cobalt and copper, though the content is as low as about 1% for each metal, these metals have industrial importance and are being exhausted on the terrestrial areas (for example, nickel ores from New Caledonia which has great nickel deposits in the world had a grade of 9% level at the beginning, but the grade has fallen to the order of 2% in recent years and, despite this, the consumption is increasing at a very high rate), and potential reserves of deep-sea manganese nodules are enormous (estimated quantities of the metals utilizable as resources are $16\times10^8$ tons for Ni, $10\times10^8$ tons for Co, $5\times10^8$ tons for Cu and $700\times10^8$ tons for Mn).

A typical example of the composition of manganese nodules is shown in Table 1. The manganese nodules in Table 1 were those collected from the sea-bed of offshore California.

TABLE 1

| Composition of Manganese Nodules | | | | | |
|---|---|---|---|---|---|
| Mn | Fe | Co | Ni | Cu | Residues |
| 16.31% | 11.8% | 0.32% | 0.53% | 0.25% | 70.8 |

It is known that the valuable metals are dispersed and incorporated in a Mn and Fe oxide mineral phase (matrix) of manganese nodules and therefore, in the utilization of the valuable metals, it is necessary to destroy the matrix to thereby change the form of Ni, Co and Cu into a form capable of being easily extracted. As the treatment therefor, a number of processes have been proposed. They include, for example, (1) direct leaching with an acid or an alkali under severe conditions, and (2) oxidative roasting or reductive roasting followed by leaching with an alkali.

However, none of these conventional processes are advantageous in the recent situation where the energy cost rises rapidly, because they require considerably severe treatment conditions and consequently expensive equipment and because a large quantity of energy must be supplied externally. Moreover, the extraction percentage of valuable metals have not been high, and particularly the extraction of cobalt has not been satisfactory in any conventional process.

A method for the treatment of manganese nodules has been previously known in which valuable metals in manganese nodules are rendered solvent-soluble by forming an electric cell using manganese nodules as a cathode active material component and discharging the cell. According to this method, manganese nodules need not be treated with a reducing agent, because the Mn matrix and the valuable metals dispersed and accommodated therein can automatically be reduced very easily by the electric discharge, and subsequent severe treatment conditions such as elevated temperatures can also be eliminated, because they are already rendered readily soluble in a solvent such as a dilute acid under very mild conditions. Moreover, the valuable metals in manganese nodules can be recovered by way of recovering energy from the manganese nodules rather than by supplying a large quantity of energy externally.

If this method is employed, however, a large quantity of Mn is also rendered solvent-soluble by the electric discharge, so that the extraction percentage of Mn would exceed 60% in the extraction treatment after the electric discharge, and it is no longer feasible to separate Mn from each of other valuable metals.

SUMMARY OF THE INVENTION

An object of this invention is to provide a novel process for treating manganese nodules wherein the solvent extraction percentage for Mn in manganese nodules can be controlled to less than 60% and that for other valuable metals be elevated to at least 80%, so that each valuable metal can be extracted and separated easily.

This invention thus provides a method for treating manganese nodules characterized in that the solvent solubility of valuable metals in manganese nodules is properly regulated by forming an alkaline-manganese type electric cell using manganese nodules as a cathode active material component and discharging the cell with a discharge load on a properly selected level.

BRIEF DESCRIPTION OF THE DRAWING

In the attached drawing.

DETAILED DESCRIPTION OF THE INVENTION

Figure 1:
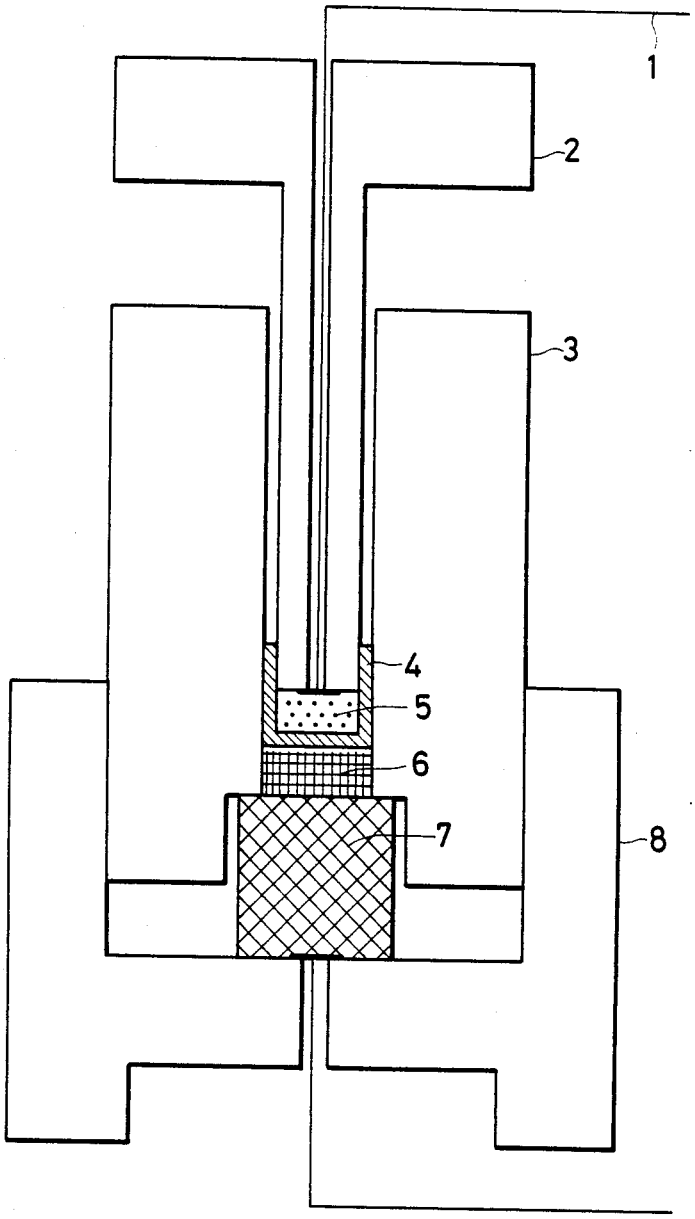
FIG. 1 is a brief longitudinal section showing the alkaline-manganese test cell containing manganese nodules as a cathode active material which was used in Examples 1 and 2.

The cell to be used in the electric discharge process for the treatment of manganese nodules according to this invention is prepared in the following manner. A cathode active material is prepared, for example, by mixing manganese nodules with an electrically conductive agent such as graphite in a ratio of 9:1 by weight and kneading 10 g of the mixture with 1 ml of a 40% KOH solution saturated with ZnO (hereinafter referred to as the electrolyte). Against 3 g of this kneaded cathode mix, an anode active material is composed, for example, of 1.1 g of amalgamated Zn powder gelled with an electrolyte containing 2.8% of CMC (carboxymethylcellulose). The cathode active material and the anode active material are built into a cell with a separator interposed therebetween as shown in FIG. 1, for example.

The cell consists of an anode active material 5 made of gelled amalgamated zinc powder, a cathode active material 6 made of the kneaded mix containing manganese nodules, and a separator 4 partitioning these electrodes, which are housed in an inner frame bobbin 3.

The anode active material 5 is held by a negative electrode holding rod 2 and is connected to a platinum current collector 1 for the negative electrode.

The cathode active material 6 is connected to a nickel current collector 7 for the positive electrode which is housed between the recessed portion at the bottom of the inner frame bobbin 3 and the recessed portion of the outer frame 8.

Figure 5:
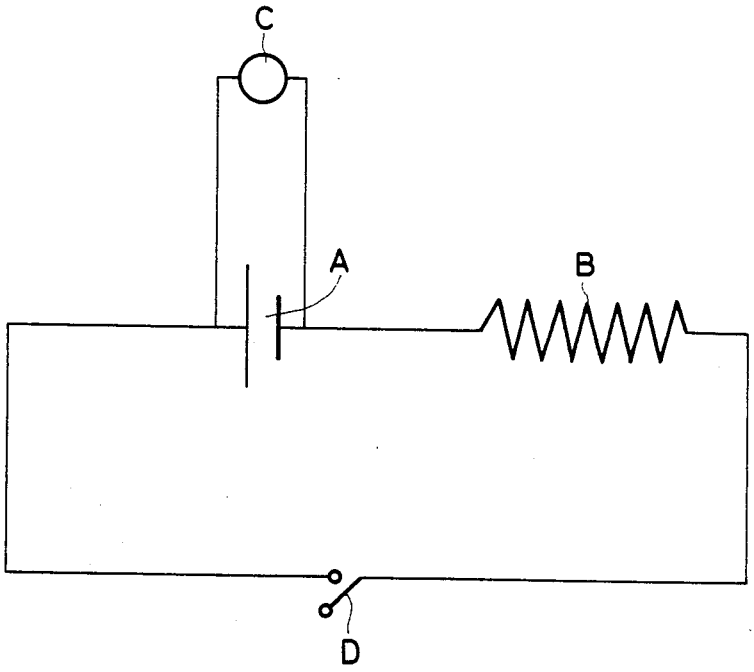
FIG. 5 illustrates the circuit for providing the alkaline-manganese electric cell with discharge load.

The cell is connected to a discharge load B and a switch D to form a discharge circuit as illustrated in FIG. 5. A recorder C may be connected in parallel to the cell A, if necessary.

As a solvent for extracting the valuable metals which have been rendered solvent-soluble by the discharge of the cell, there can be used a mineral acid such as sulfuric acid, hydrochloric acid, or nitric acid, or aqueous ammonia. Sulfuric acid, however, is particularly preferred because of easiness of after-treatment, freedom from expensive equipment, inexpensiveness and availability in abundance. The concentration of sulfuric acid should be 0.5 to 10 mol/l, preferably 1 to 3 mol/l. It is possible to extract 90 to nearly 100% of the valuable metals in manganese nodules at a temperature of below 100° C. within a short time, by using dilute sulfuric acid in slight excess over the theoretical value required for the valuable metal components contained therein to form their metal salts. Particularly, with respect to Co whose extraction has been extremely difficult by any conventional method, a highly improved extraction of 80 to 90% or higher is possible by the present invention.

Subsequent separation of the components from the solution obtained upon extraction of valuable metals from manganese nodules, can be effected easily by known processes.

As described above, the process of this invention is quite a novel process for treating manganese nodules by utilizing an alkaline-manganese cell reaction. This invention has technical features that the Mn matrix and the valuable metals dispersed and stored therein can be automatically reduced extremely easily by electric discharge, without intentional addition of any reducing agent, so that subsequent severe treatments such as application of high temperatures can be avoided, and they are endowed with abilities to dissolve in a solvent such as a dilute acid under very moderate conditions within a short time. Furthermore, unlike conventional processes wherein a large quantity of energy must be supplied externally, this invention has an advantage heretofore not known in that the valuable metals in manganese nodules are rendered solvent-soluble while energy is being recovered from the manganese nodules in alkaline-manganese electric cell system. Moreover, in this invention, the extraction percentage for Mn can be reduced to less than 60%, and that for all other valuable metals be increased to 80 to 90% or higher, by properly selecting the electric discharge load of the cell system. Subsequent separation of the valuable metals is facilitated thereby. Mn would often be excluded from valuable metals, and there could be cases where it is rather convenient for subsequent procedures to leave the metal insoluble. According to this invention, therefore, a heretofore unexpected advanrage can be obtained in such cases where Mn is desired to be kept insoluble as much as possible.

Particularly with respect to Co whose extraction has been extremely difficult by conventional methods, extraction of 80 to 90% or higher is easily attained by the present invention.

This invention is illustrated below in further details with reference to examples, but the invention shall not be limited to these examples.

In these examples, % and parts are by weight, unless otherwise specified.

EXAMPLE 1

Figure 2:
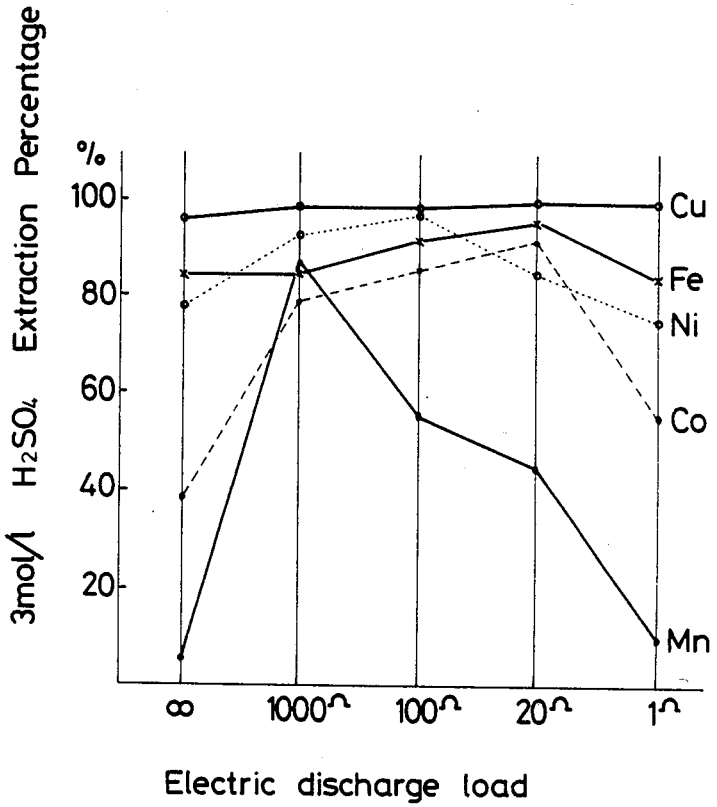
FIG. 2 is a graph showing the relation between the electric discharge load and the extraction percentage of valuable metals in Example 1.

Nine (9) parts of manganese nodule powder containing 16.31% of Mn, 11.8% of Fe, 0.53% of Ni, 0.25% of Cu and 0.32% of Co was mixed with 1 part of graphite, and 10 g of the mixture was kneaded with 1 ml of the electrolyte to give a mix, 3 g of which was used as a cathode active material. On the other hand, 11 g of amalgamated Zn powder gelled with 0.7 ml of a 40% KOH solution containing 2.8% of CMC was used as an anode active material. The cathode active material and the anode active material were assembled into an alkaline-manganese test cell shown in FIG. 1. The cell was discharged with discharge loads of 1 kΩ, 100Ω, 20Ω and 1Ω and then each product of the cathode active material was reacted with 100 ml of 3 mol/l dilute sulfuric acid at 80° to 90° C. for 1 hour. The metal extraction results are shown in Table 2 and FIG. 2.

The electric energy recovered from the cell discharged with constant resistance of 20Ω is about 18.4 mA H/g-nodule (where the cell is discharged down to 0.8 V). The energy may be stored in battery or used directly.

TABLE 2

| Test No. | Discharge load | Extraction percentage Mn | Fe | Ni | Co | Cu |
|---|---|---|---|---|---|---|
| | Ω | | | | | |
| 1-1 | ∞ | 4.9 | 86.1 | 79.2 | 39 | 96 |
| 1-2 | 1000 | 88 | 86.5 | 91.5 | 79 | 99.7 |
| 1-3 | 100 | 57.5 | 91.5 | 97 | 87.5 | 98.5 |
| 1-4 | 20 | 46.5 | 96.5 | 85.5 | 92 | 100 |
| 1-5 | 1 | 10 | 84.5 | 75.5 | 55 | 100 |

Electric Discharge Load and Extraction Percentage of Valuable Metals

A remarkable correlationship was found between the discharge load and the extraction percentage of valuable metals. The extraction of Cu, Ni and Co was above 85% to nearly 100% when the discharge load was 20 to 100%. Moreover, the heavier the discharge load, the lower was the extraction percenrage of Mn, which suggests that the procedure for separating each of other components can be made far easier than in conventional methods. Furthermore, in contrast to the energy-consuming type process in conventional methods, the present procedure for extracting valuable metals is advantageous in economy of energy, because electric energy amounting to about 50 mA H/g is recovered at the same time from the manganese nodules.

EXAMPLE 2

Figure 3:
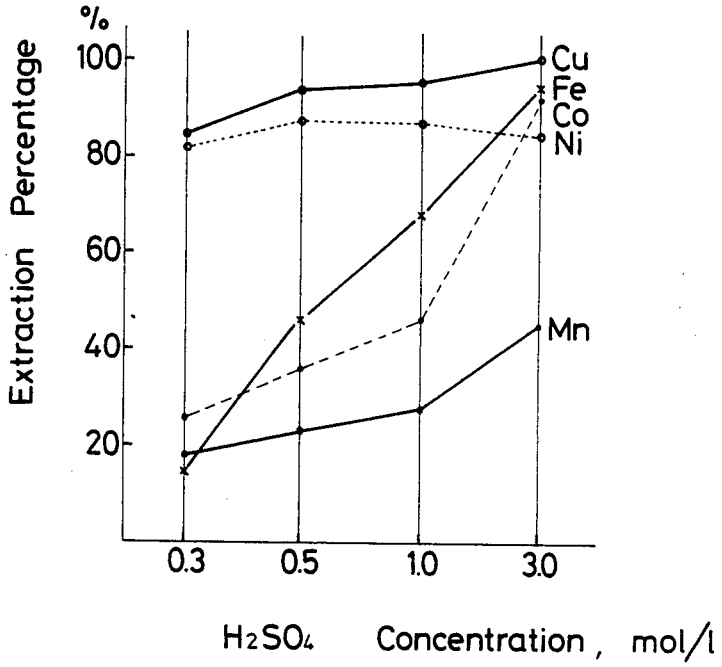
FIG. 3 is a graph showing the relationship between the $H_2SO_4$ concentration and the extraction percentage of each metal by $H_2SO_4$, in the manganese nodules following the electric discharge process in Example 2 according to this invention.

The same manganese nodules as in Example 1 were assembled into the same test cell as in Example 1, and the cell was descharged with constant resistance of 20Ω. The cathode active material was subsequently taken out and was reacted with 100 ml of dilute sulfuric acid in varied concentrations of 0.3, 0.5, 1 and 3 mol/l at 80° to 90° C. for 1 hour. The metal extraction results are shown in Table 3 and FIG. 3.

TABLE 3

| $H_2SO_4$ Concentration in Cathode Mix after Electric Discharge and Extraction Percentage of Valuable Metals | | | | | | |
|---|---|---|---|---|---|---|
| Test | Sulfuric acid | Extraction percentage (%) | | | | |
| No. | concentration | Mn | Fe | Ni | Co | Cu |
| 2-1 | 0.3 mol/l | 18.6 | 15.9 | 82.7 | 26.6 | 83.3 |
| 2-2 | 0.5 | 22.2 | 47.7 | 88.6 | 36.4 | 94.2 |
| 2-3 | 1.0 | 27.1 | 68.9 | 88.6 | 46.1 | 96.7 |
| 2-4 | 3.0 | 46.5 | 96.5 | 85.5 | 92 | 100 |

As shown in this example, when manganese nodule after being subjected to the discharge process was extracted with 3 mol/l dilute sulfuric acid (under heating), values of extraction percentage higher than 80% were obtained for all the metals intended for recovery.

COMPARATIVE EXAMPLE 1

In order to further manifest the effects of this invention, 3 g of manganese nodule having the same composition and particle size as in Example 1 was directly reacted with 100 ml of dilute sulfuric acid in varied concentrations shown in Example 2 under heating (80° to 90° C.) for 1 hour, without application of the treatment of this invention (alkaline-manganese discharge). The metal extraction results thereof are shown in Table 4 and FIG. 4.

TABLE 4

| Direct Extraction of Valuable Metals from Manganese Nodules with Sulfuric Acid in Varied Concentrations | | | | | | |
|---|---|---|---|---|---|---|
| Test | Sulfuric acid | Extraction percentage (%) | | | | |
| No. | concentration | Mn | Fe | Ni | Co | Cu |
| 1 | 0.3 mol/l | 4.1 | 28 | 73.6 | 0.6 | 100 |
| 2 | 0.5 | 3.5 | 43.2 | 73.6 | 0.75 | 97.6 |
| 3 | 1.0 | 2.6 | 61 | 79.2 | 0.94 | 98.4 |
| 4 | 3.0 | 4.9 | 86.1 | 79.2 | 39 | 96 |

Figure 4:
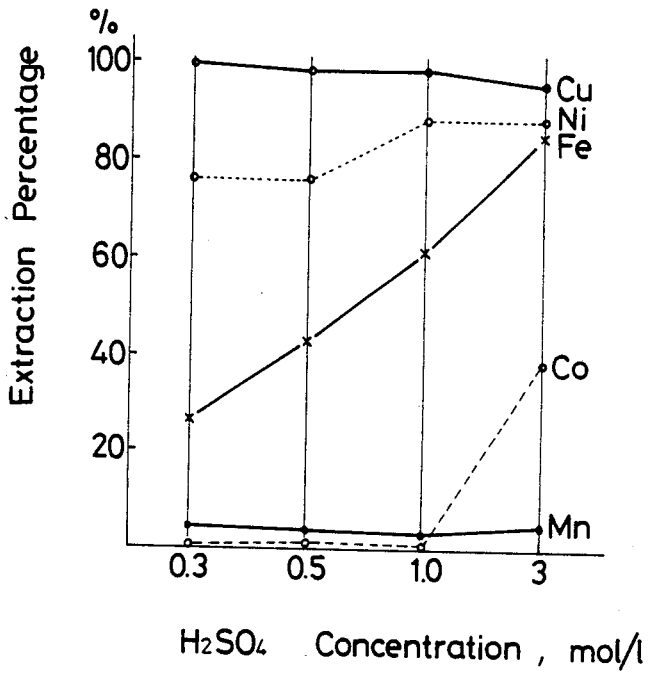
FIG. 4 is a graph showing the relationship between the $H_2SO_4$ concentration and the extraction percentage of each metal by $H_2SO_4$, in the manganese nodules in the comparative example.

As shown in Table 4 and FIG. 4, extraction with sulfuric acid alone, not preceded by the treatment in accordance with this invention, gave low extraction percentages for all metals other than Cu, particularly for Mn and Co: An attempt to extract Mn separately from other valuable metals resulted in a great decrease in the extraction of Co to the order of 40%. By the present invention, however, extraction of Mn was successfully controlled to the order of 40% while extraction of Co was maintained in a high yield of above 90%.

We claim:

1. A process for treating manganese nodules which comprises forming an alkaline-manganese electric cell using the manganese nodules as a cathode active material component and an amalgamated Zn powder as an anode active material component and discharging said cell with a selected discharge load to thereby alter the solvent solubility of valuable metals in the manganese nodules.

2. A process in accordance with claim 1, wherein a mix obtained by kneading a mixture of manganese nodules and an electrically conductive agent with an alkaline electrolyte is used as a cathode active material, an amalgamated Zn powder gelled with an alkaline electrolyte is used as an anode active material, and the cathode active material and the anode active material are assembled into an alkaline-manganese electric cell with a separator interposed therebetween.

3. A process in accordance with claim 1, wherein the solvent solubilities of valuable metals are altered so that the solvent extraction percentage for Mn is less than 60% and that for other valuable metals is increased to above 80%.

4. A process in accordance with claim 3, wherein the extraction solvent is a mineral acid.

5. A process in accordance with claim 4, wherein the extraction solvent is sulfuric acid.

* * * * *